US005190410A

United States Patent [19]

Nunley

[11] Patent Number: 5,190,410

[45] Date of Patent: Mar. 2, 1993

[54] CONVERSION OF MAT JACK-UP DRILLING PLATFORMS TO FLOATING DRILLING PLATFORMS

[76] Inventor: Dwight S. Nunley, 500 Oakwood Dr., Gretna, La. 70056

[21] Appl. No.: 775,212

[22] Filed: Oct. 11, 1991

Related U.S. Application Data

[63] Continuation-in-part of Ser. No. 606,143, Oct. 31, 1990, abandoned.

[51] Int. Cl.[5] ..... E02B 17/00

[52] U.S. Cl. ..... 405/196; 405/203; 405/204

[58] Field of Search ..... 405/196–200; 254/95, 107, 112

[56] References Cited

U.S. PATENT DOCUMENTS

| | | | |
|---|---|---|---|
| 3,628,336 | 12/1971 | Moore | 405/196 |
| 3,699,688 | 10/1972 | Estes | 405/197 |
| 3,828,561 | 8/1974 | Moore et al. | 405/197 |
| 3,830,071 | 8/1974 | Le Tourneau | 405/197 |
| 3,844,127 | 10/1974 | Koop et al. | 405/197 |
| 4,627,767 | 12/1986 | Field et al. | 405/196 |

*Primary Examiner*—Dennis L. Taylor

[57] ABSTRACT

A mat jack-up drilling platform converted to a floating drilling platform. The mat jack-up platform, which normally contains a platform, a mat for resting on the seafloor, and legs attached at one end to the mat and on which the platform can be raised and lowered, is converted to a floating rig by jacking the mat to the platform, permanently joining the mat to the platform, and removing the legs.

11 Claims, 5 Drawing Sheets

CONVERSION OF MAT JACK-UP DRILLING PLATFORMS TO FLOATING DRILLING PLATFORMS

CROSS REFERENCE TO RELATED APPLICATIONS

This is a continuation-in-part of U.S. Ser. No. 606,143, filed Oct. 31, 1990, now abandoned.

FIELD OF THE INVENTION

The present invention relates to the conversion of a mat supported jack-up drilling platform to a floating drilling platform. The conversion is accomplished by jacking the mat to the platform, permanently affixing the mat to the platform, and removing the legs.

BACKGROUND OF THE INVENTION

Offshore exploratory drilling is usually done using self-contained bottom supported platforms and floating drilling platforms, or rigs, that can be easily moved. One of the most common types of bottom-supported rigs are the jack-up rigs wherein the legs of the rig are permanently attached to the mat which is jacked up and down in relation to the platform. The term drilling platform and rig will be used interchangeably herein. One type of jackup rig is the independent jack-up rig which is towed to location with its legs elevated. On location, the legs are lowered to the bottom and the platform is "jacked up" above the wave action by means of hydraulic jacks or electric motor rack and pinion equipment which are located within the platform structure, typically in a so-called pod house.

Another type of commonly used jack-up rig is the so called mat supported jack-up rig, which is typically used for soft bottom conditions. The mat supported jack-up rig is comprised of a base mat to which a plurality of legs are attached, and a working platform which may be moved up and down on the legs with respect to the base mat, but above the wave action. The mat is typically a hollow oblong structure, preferably rectangular in shape, and of appropriate dimensions for providing stability for the rig when resting on the seafloor. The mat structure usually contains one or more cutouts for such things as allowing access to the seafloor for drilling, and for helping to relieve any suction that may have developed under the mat, thereby making it easier to raise the mat from the seafloor when relocating the rig.

The interior of the mat typically contains compartments, such as ballast compartments, which can be judiciously flooded to the appropriate degree to make the mat neutrally buoyant. The mat is made neutrally buoyant on conventional mat supported jack-up rigs for greater stability for both towing and for when the mat is in its normally seafloor position on location. For example, if the mat of a conventional jack-up rig had a positive buoyancy, it would exert too much upward force on the platform during towing, thus making it unstable and unseaworthy. On the other hand, if the mat were less than neutrally buoyant, it would tend to drag the platform underwater during towing, also making it unseaworthy. Once moved into position, the neutrally buoyant mat is lowered and raised more easily than if were not neutrally buoyant.

While bottom supported rigs, such as the jack-up rig, can be used in most locations where the water depth is less than about 200 feet, preferably less than about 150 feet, there are still some locations, even in relatively shallow waters, where bottom supported rigs are not desirable. For example, in some locations, such as at mouths of rivers, and in some soft bottom lakes, neither the mat supported jack-up rig nor the independent jack-up rig are suitable for use. For example, the bottom conditions may be too soft to support the independent jack-up rig, and the mat supported jack-up rig may pose too great a risk at locations which have been so extensively developed that a network of seafloor pipelines must be protected in the vicinity of the proposed rig. While it would be desirable to use floating rigs in such locations, some floating rigs present their own set of problems. For example, cantilever type floating rigs, which may be successfully used in the drilling operation, may not be readily adaptable to a workover role, which typically requires more exacting positioning between the rig and the well. Generally, there is less tolerance for vertical movement of the drillfloor/drillstring assembly in workover operations. Any wind, swell, current, wave action, and the like, imparts a magnified amplitude motion vertically at the wellhead, which presents both safety and operational problems. Thus, there is a need in the art for an economical floating rig having improved stability which can be used in such locations and which can compensate for, or minimize, motion due to wave action, etc.

SUMMARY OF THE INVENTION

In accordance with the present invention, there is provided a method for converting a mat supported jack-up rig to a floating rig, which mat supported jack-up rig is comprised of a plurality of legs having a supporting mat attached at one end and having a means for which a platform can move up and down; a mat for supporting the rig on the seafloor, and a platform which normally is situated above the wave action; the method which comprises: (a) jacking the mat to the platform; (b) permanently joining the top of the mat to the bottom of the platform; and (c) permanently removing the legs.

In preferred embodiments of the present invention, the sides of the mat extend downward past the main hollow structure, thereby forming a bilge, or rolling keel plate, along the lower periphery of the mat structure.

In other preferred embodiments of the present invention, the platform and mat are secured to each other by use of metal plates which are welded so as to permanently join the bottom periphery of the platform to the upper surface of the mat.

DETAILED DESCRIPTION OF THE INVENTION

Bottom supported rigs which can be modified in accordance with the present invention are any of the so-called mat supported jack-up rigs. Such rigs are comprised of a base mat for normally resting on the seafloor; a plurality of legs which are permanently attached to the mat at one end and on which a platform can be raised and lowered by jacking; and a platform, which normally sits above the wave action. The mat portion of the rig can be any of the conventionally used mats. Such mats are generally hollow structures and contain one or more cutouts to accommodate various seafloor operations and movement of the rig from location to location. The mat is typically constructed so that it is substantially larger in area than the platform in order to provide maximum stability. Furthermore, the mat is typically constructed so that its hollow interior contains a plurality of ballast compartments which can be flooded to the desired degree in order to make the mat neutrally buoyant. For purposes of the present invention, it is desirable to make the mat as buoyant as possible, so it can support the platform in a floating mode. Consequently, if some of the interior compartments of the mat already contain water, the water should be expelled. Also, if the mat contains a cutout to aid in raising the mat off of the seafloor by relieving any suction under the mat, it can be closed-in to provide another watertight hollow section of the mat which will contribute to the buoyancy of the mat.

Figure 1:
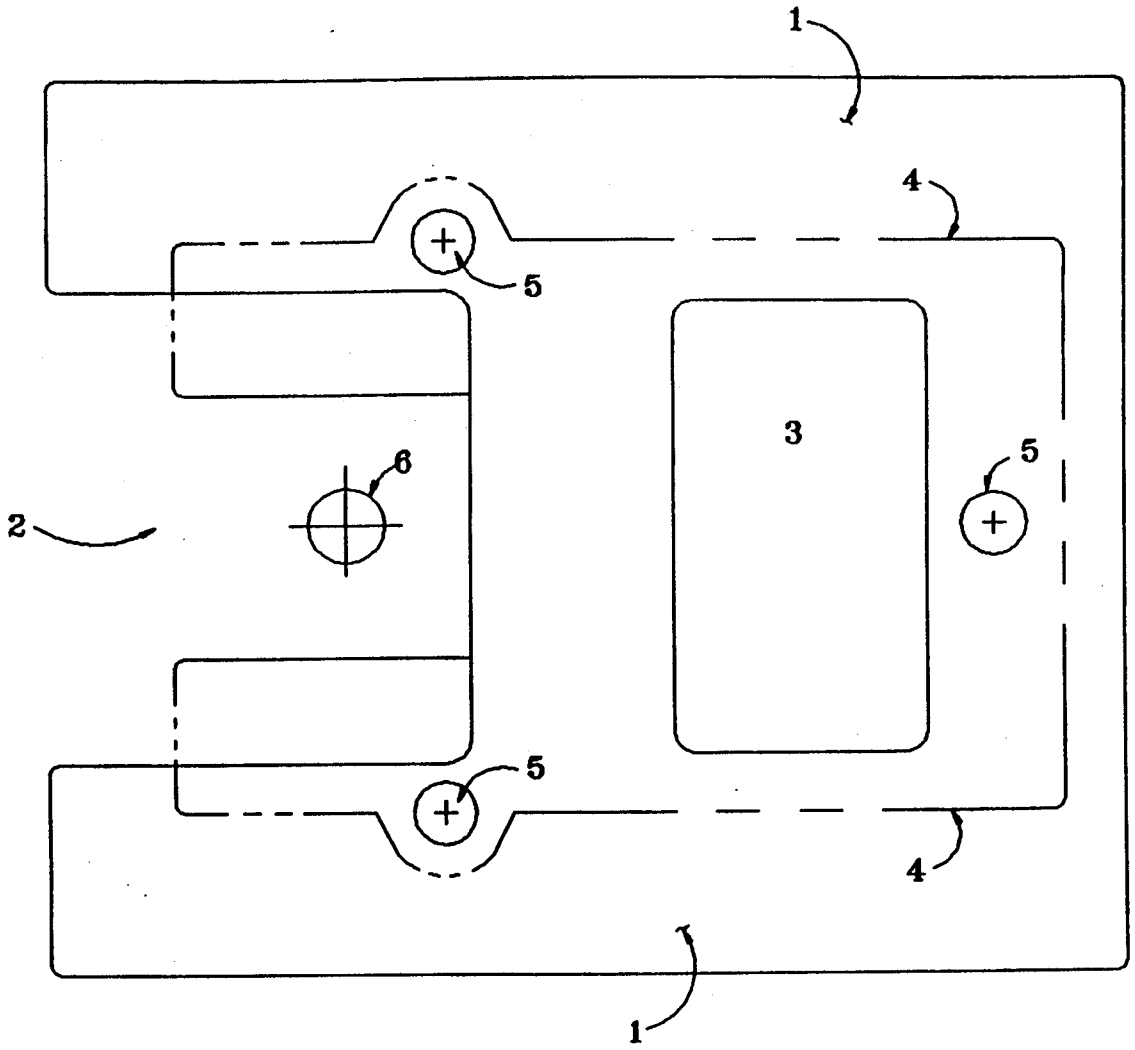
FIG. 1 is a top view of a typical mat for a mat supported jack-up rig showing cutouts for unobstructed access to the seafloor and for relieving suction which may develop under the mat.

FIG. 1 hereof is a top view of a typical mat 1 used on a mat supported jack-up rig. The mat, which is rectangular in shape, contains a cutout 2 for unobstructed access to the seafloor and clearance around the platform for wellhole work under the derrick on the platform. Cutout 3 is for relieving suction from under the mat in the event the mat is to be raised from the seafloor. Thus, with the cutouts, the mat is shaped somewhat like the letter A, although it is still considered rectangular in shape, and having four peripheral corners. In the practice of the present invention, it is preferred to fill-in cutout 3 by securing a plate at the bottom and at the top, thereby creating another hollow space within the interior of the mat to contribute to its buoyancy. If desired, one or more of the hollow compartments of the mat can be filled with a material, such as a foam, which will help maintain buoyancy in the event of a leak into said interior compartment.

The dashed lines 4 of this FIG. 1 show an outline of a typical platform and its relative area size relationship to the mat of a typical mat supported jack-up rig. In such a typical rig, the mat is about 170 ft. by 210 ft. by 10 ft. in height. Of course, the mat can vary widely in size depending on the designed rig size and location where the rig is to be used. The location of the legs are shown by circles 5 within the outline of the platform. The holes represented by 5 are part of the so-called pod house wherein the legs can be raised through the platform structure by a jacking means. The jacking means, which is situated inside of each pod house, typically includes a hydraulic jacking system which is comprised of a vertical jacking cylinder/yoke assembly. The jacking means may alternatively be comprised of a rack and pinion assembly. A wellhole 6 will be situated directly under the derrick of the converted rig of the present invention when in use. Although not shown in this figure, conventional mats typically contain an extended sidewall, or skirt, which extends beyond the bottom of the mat and which serves to prevent scouring under the mat when resting on the seafloor. When using the mat as a floatation means in accordance with the present invention, this skirt adds to the stability of the rig by acting as a bilge, or rolling keel. This skirt usually extends a few feet past the bottom of the mat on conventional mats.

The rig, as modified, can be held in position by any appropriate means. For example, it can be held in position by use of double drum hydraulic anchor windlasses which can be driven by the hydraulic power packs and reservoirs formerly utilized on the rig before modification for jacking-up the platform. These double drum windlasses can contain mooring wires, preferably 8 wires, leading through fairleads and terminating at anchors conformally arrayed to restrain the rig in all directions. The rig is easily maneuverable by taking up and paying out on the various wires, such as when powering the rig off of the wellhead in case of bad weather or a blowout.

Figure 2:
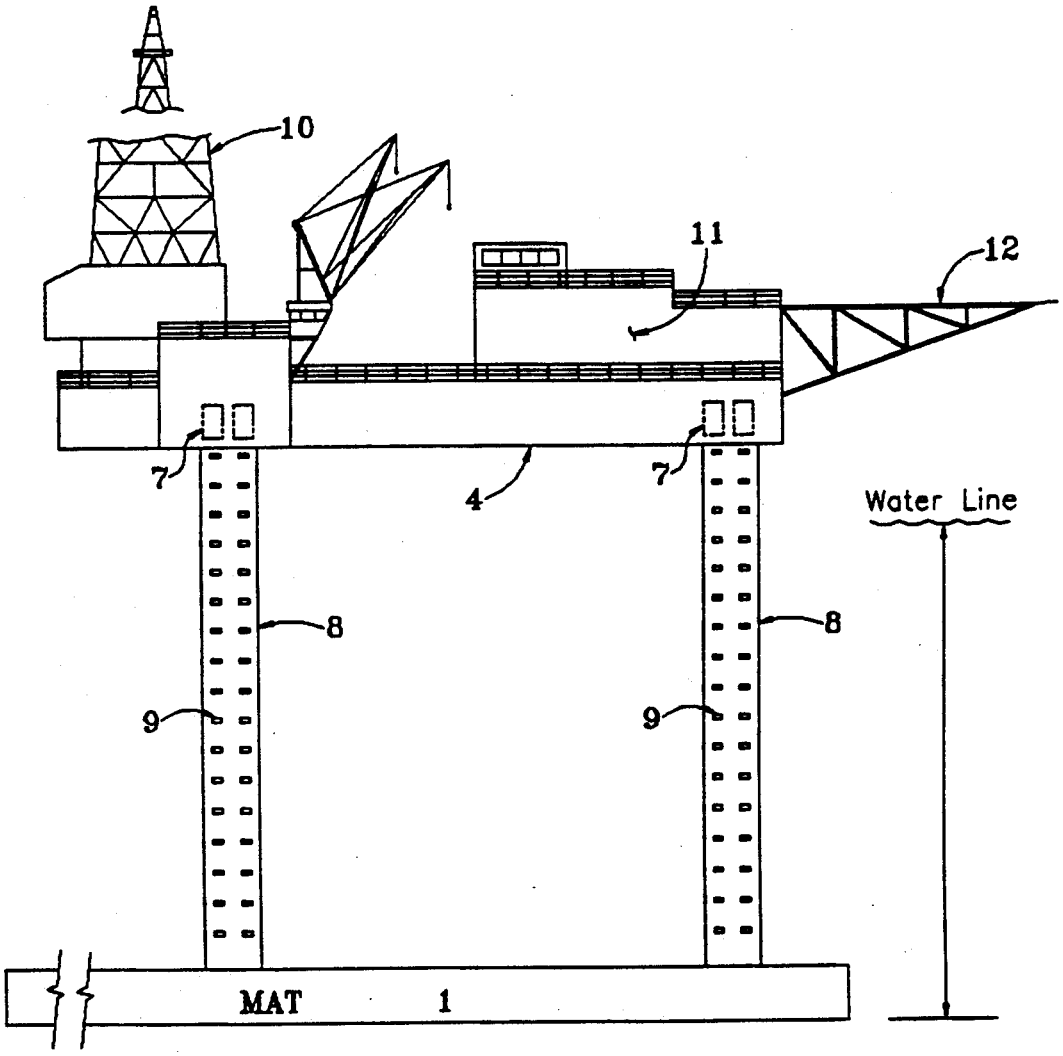
FIG. 2 is a side view of a typical mat supported jackup rig positioned on location showing the mat in its normally seafloor position and the platform above the wave action.
Figure 4:
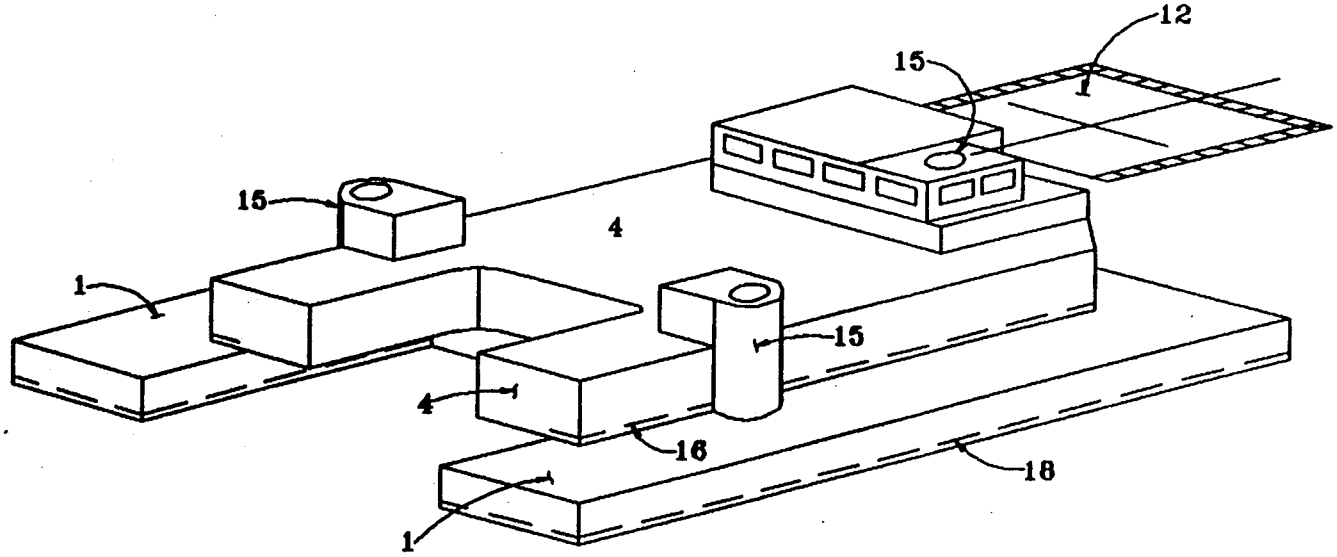
FIG. 4 is a perspective view of a converted mat supported jack-up rig to a floating rig in accordance with this invention. This figure shows a preferred joining means which includes a coaming plate which is welded along the bottom section of the sides of the platform and the top surface of the mat.
Figure 5:
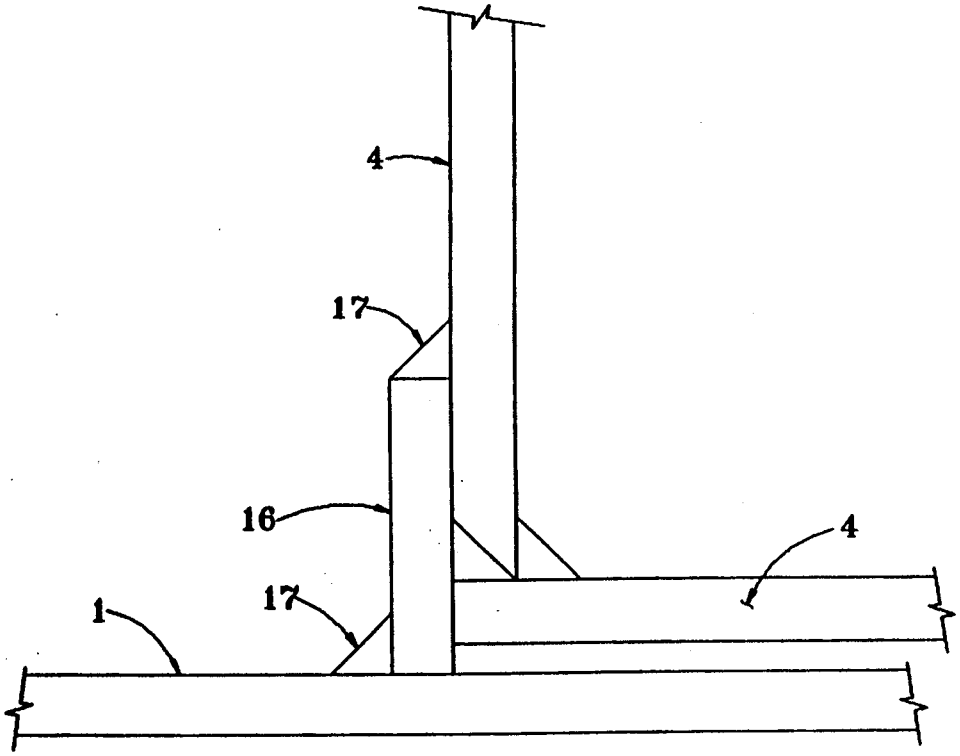
FIG. 5 is a detailed side view of the section of mat and platform joined by a metal plate which is welded to both.

FIG. 2 hereof shows a side view of a representation of a typical mat supported jack-up rig in which the mat 1 is in its normally seafloor position. Legs 8, which are shown herein as columns, are rigidly attached at one end to mat 1 and extend upward to the platform 4. The legs need not be columns, but may be any which will be found on supported jack-up rigs, and may be fabricated from a plurality of members such as beams, bars, rods, etc., including truss shaped columns. The platform supports the surface equipment, including a derrick 10, deck house, or living quarters 11, and helipad 12. The legs, which are not permanently affixed to the platform, are designed to allow the platform to be moved up and down on the legs by jacking means 7, which was previously described, and which, for purposes of this figure, engage openings 9 in the legs to produce relative movement between the platform 4 and legs 8. Accordingly, the legs 8 will be operated substantially in unison to produce the required relative movement. Of course, when the platform is sitting in the water, the jacking mechanism can be thought of as jacking the mat to the platform. In any event, jacking will either move the platform and mat closer together, or further apart. In an operation on a typical mat supported jack-up rig, the legs are removed by jacking them up (or lowering the upper platform down) utilizing the jacking means of the rig, which will usually take a six foot stroke on a rig which utilizes a hydraulic jacking system. At the end of each 3 strokes, the section of leg protruding above the pod house is severed by flame cutting and lifted off by a crane and discarded. This is repeated until all of the leg is removed. The jacking means can then be removed from the pod house and moved off the rig. This will increase the buoyancy of the rig. A metal plate, such as a coaming plate (as shown in FIGS. 4 and 5 hereof) is provided around the area bounded by the upper hull, or platform, lapped along the outside of the shell plating and extending downward to the upper surface of the mat top plating. The coaming plate is welded, thereby permanently joining the mat to the platform. The mat is now a permanent part of the platform and because of its buoyancy, the entire structure can now act as a floating rig.

Figure 3:
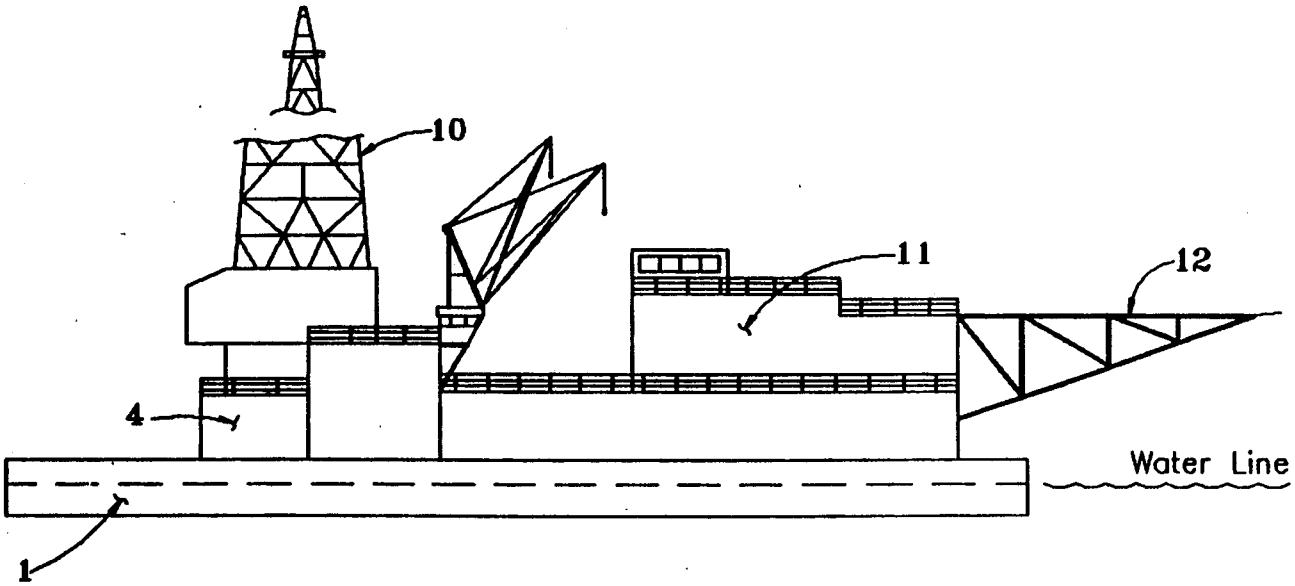
FIG. 3 is a side view of the same mat supported jack-up rig, but converted to a floating rig by permanently joining the mat to the platform and then removing its legs.

FIG. 3 hereof shows a side view of the same rig as in FIG. 2 hereof except it has been converted to a floating rig, by jacking the mat to the platform, permanently joining the mat to the platform, and removing the legs. The legs, or course, which have no further use on the floating platform of the present invention, are discarded.

FIG. 4 hereof is a perspective view of the floating rig of the present invention wherein mat 1 is permanently joined, or affixed, to the bottom of the platform 4. Items, such as the drilling derrick, cranes, etc. are not shown in this figure for purposes of clarity. This figure shows pod houses 15 where the legs, which are not shown because they were already removed, would pass through the platform structure. The mat is shown permanently joined to the platform by a metal plate 16 which would extend around the periphery of the bottom outside wall of the platform and extend to the top surface of the mat. The metal plate, which is actually a series of plates and is sometimes called a coaming plate, is welded along the top to join the platform and at the bottom to join the mat. Also shown by dashed lines 18 in this figure is skirt, or extended side wall of the mat, which was discussed previously herein.

FIG. 5 hereof is a detailed side view of the metal plate 16 which is welded to both the platform 4 at its lower sidewall and to the top surface of the mat 1. The welds are shown by 17 in this figure.

What is claimed is:

1. A floating drilling rig which is comprised of a platform which supports surface equipment comprising a derrick, living quarters, a helipad, and the like, which platform is welded to a floatable mat by a plurality of metal plates which are welded around the periphery of the lower outside side plating of said platform and to the top of said mat, which platform and mat were component parts of a bottom supported jack-up rig.

2. The rig of claim 1 wherein the mat contains a cut-out to allow for lifting said mat from a seafloor, which cutout is enclosed by a metal plate which is secured on the top surface and a metal plate which is secured to the bottom surface of said mat, which plates covers said cut-out, thereby enclosing said cut-out and creating another compartment in the mat to enhance its buoyancy.

3. The rig of claim 2 wherein said compartment contains floatable material.

4. The rig of claim 3 wherein the floatable material is a foam material.

5. The method of claim 1 wherein the mat originally contained a cut-out to allow for lifting said mat from a seafloor, which cut-out is enclosed by securing a metal plate to the top surface and a metal plate to the bottom surface of said mat, which plates enclose said cut-out and creating another compartment in the mat to enhance its buoyancy.

6. A method for converting a mat supported jack-up drilling rig comprised of a mat for resting on the seafloor, a plurality of legs which are attached to the mat at their lower end and which legs contain means by which a jacking means can move the platform up and down on the legs, and a platform which normally is positioned above the wave action; which method comprises raising the mat to the platform by jacking the legs upward through the platform until said mat is contiguous to said platform; removing vertical lengths of said legs as they are jacked through said platform; and welding the mat to said platform by a plurality of metal plates which are welded around the periphery of the lower outside side plating of said platform and to the top of said mat.

7. The method of claim 6 wherein the mat is joined to the platform by welding, one side of a plurality of metal plates around the periphery of the lower outside wall section of the platform, and the other side of said plates to the to of the mat.

8. The method of claim 6 which further comprises permanently removing said jacking means from said platform structure after removing said legs.

9. The method of claim 6 wherein the mat originally contained a cut-out to allow for lifting said mat from a seafloor, which cut-out is enclosed by securing a metal plate on the top surface and a metal plate to the bottom surface of said mat, which plates enclose said cut-out, thereby creating another compartment in the mat to enhance its buoyancy.

10. The method of claim 9 which further comprises filling said compartment with a floatable material.

11. The method of claim 10 wherein the floatable material is a foam material.

* * * * *